US010600344B1

(12) United States Patent
Lorenzini et al.

(10) Patent No.: US 10,600,344 B1
(45) Date of Patent: Mar. 24, 2020

(54) DIMENSIONAL DISPLAY BOARD

(71) Applicants: Ann Louise Lorenzini, Waterford, VT (US); Peter Alan Christopher, Waterford, VT (US)

(72) Inventors: Ann Louise Lorenzini, Waterford, VT (US); Peter Alan Christopher, Waterford, VT (US)

( * ) Notice: Subject to any disclaimer, the term of this patent is extended or adjusted under 35 U.S.C. 154(b) by 1 day.

(21) Appl. No.: 16/372,855

(22) Filed: Apr. 2, 2019

Related U.S. Application Data

(63) Continuation-in-part of application No. 29/644,195, filed on Apr. 16, 2018.

(51) Int. Cl.
*G09F 15/00* (2006.01)

(52) U.S. Cl.
CPC ..... *G09F 15/0062* (2013.01)

(58) Field of Classification Search
CPC ..... G09F 15/0062; G09F 1/06; G09F 1/04
See application file for complete search history.

(56) References Cited

U.S. PATENT DOCUMENTS 471,104 A 3/1892 Daniels
1,486,695 A * 3/1924 Singer ..... B65D 5/5253 206/747
1,557,332 A * 10/1925 Robbins ..... G09F 1/04 40/312
1,710,330 A * 4/1929 Ziemmerman ..... G09F 1/04 40/124.18
3,225,474 A * 12/1965 Dusseau ..... G09F 1/04 40/124.09
3,469,335 A 9/1969 Leigh
3,755,942 A * 9/1973 Samsing ..... B65D 73/0021 40/607.11
5,911,522 A 6/1999 Wood
5,960,848 A * 10/1999 Schirer ..... G09F 15/0068 160/135
6,382,433 B1 5/2002 Podergois
6,612,061 B2 * 9/2003 Janetzke ..... A47G 1/141 40/124.16
7,434,340 B2 10/2008 Virvo
7,451,800 B2 11/2008 Johnson
7,596,896 B2 10/2009 Crowell
7,823,309 B2 11/2010 Albenda
7,886,465 B2 2/2011 Virvo
D653,880 S 2/2012 Polidoros
D706,872 S 6/2014 Dashe
8,955,243 B2 * 2/2015 Dashe ..... G09F 1/06 40/539
D739,467 S 9/2015 Dashe
9,129,537 B1 * 9/2015 Lorenzini ..... G09F 1/06
D752,663 S 4/2016 Lorenzini et al.
9,495,886 B2 11/2016 Dashe
10,163,378 B1 * 12/2018 McGrath ..... G09F 15/0062
2005/0086842 A1 * 4/2005 Ternovits ..... G09F 15/0012 40/539
2005/0155259 A1 * 7/2005 Virvo ..... G09F 1/06 40/124.09
2006/0048421 A1 * 3/2006 Oleksak ..... G09F 15/0068 40/610
2018/0225995 A1 * 8/2018 Dashe ..... G09F 15/0006

* cited by examiner

*Primary Examiner* — Gary C Hoge

(57) ABSTRACT

Display boards of the kind generally used for presentations in educational and business settings, for example, and that can be made from a variety of materials including rigid paper pulp, corrugate, plastic polymers and foam are provided with openings in the board for creating dimensions.

11 Claims, 12 Drawing Sheets

DIMENSIONAL DISPLAY BOARD

CROSS-REFERENCE TO RELATED APPLICATIONS

This application claims the benefit of Design patent application No. 29/644,195 filed on Apr. 16, 2018.

STATEMENT REGARDING FEDERALLY SPONSORED RESEARCH OR DEVELOPMENT

Not applicable.

FIELD OF THE INVENTION

This invention relates to poster or display boards for presentations.

BACKGROUND OF THE INVENTION

Display boards are manufactured in a variety of shapes and styles, the most popular being tri-fold poster boards made of rigid paper pulp, plastics, and foam material that is divided into folding panels with score marks.

Typically, poster boards are placed on tables and are used to exhibit information, usually in educational or business settings. In these contexts, poster boards are often fitted with header cards. This configuration adds dimension, which maybe more esthetically pleasing, and provides a prominent location for headline display.

When using display boards in this manner the header card is typically mated to the display board with joining slots. This popular technique for presentation improvement requires the user to often purchase two individual parts for their display which may add to production costs. In addition, the user may need to secure both poster board and header card for portability. Lastly, frequent display board and header card assembly can degrade appearance and limit the life of the display board.

Therefore, what is needed is a one-piece dimensional display board that is economical, portable and does not require two-piece assembly.

SUMMARY OF THE INVENTION

The present invention provides an improvement to display boards with dimensional segments.

DETAILED DESCRIPTION OF PREFERRED EMBODIMENTS

Display boards for use in presentations are typically constructed from paper pulp, polymers or foam, including foam board, corrugated plastic and corrugated cardboard. A common example is a poster board and header card that is stood up on a table or other surface while being displayed.

Figure 1:
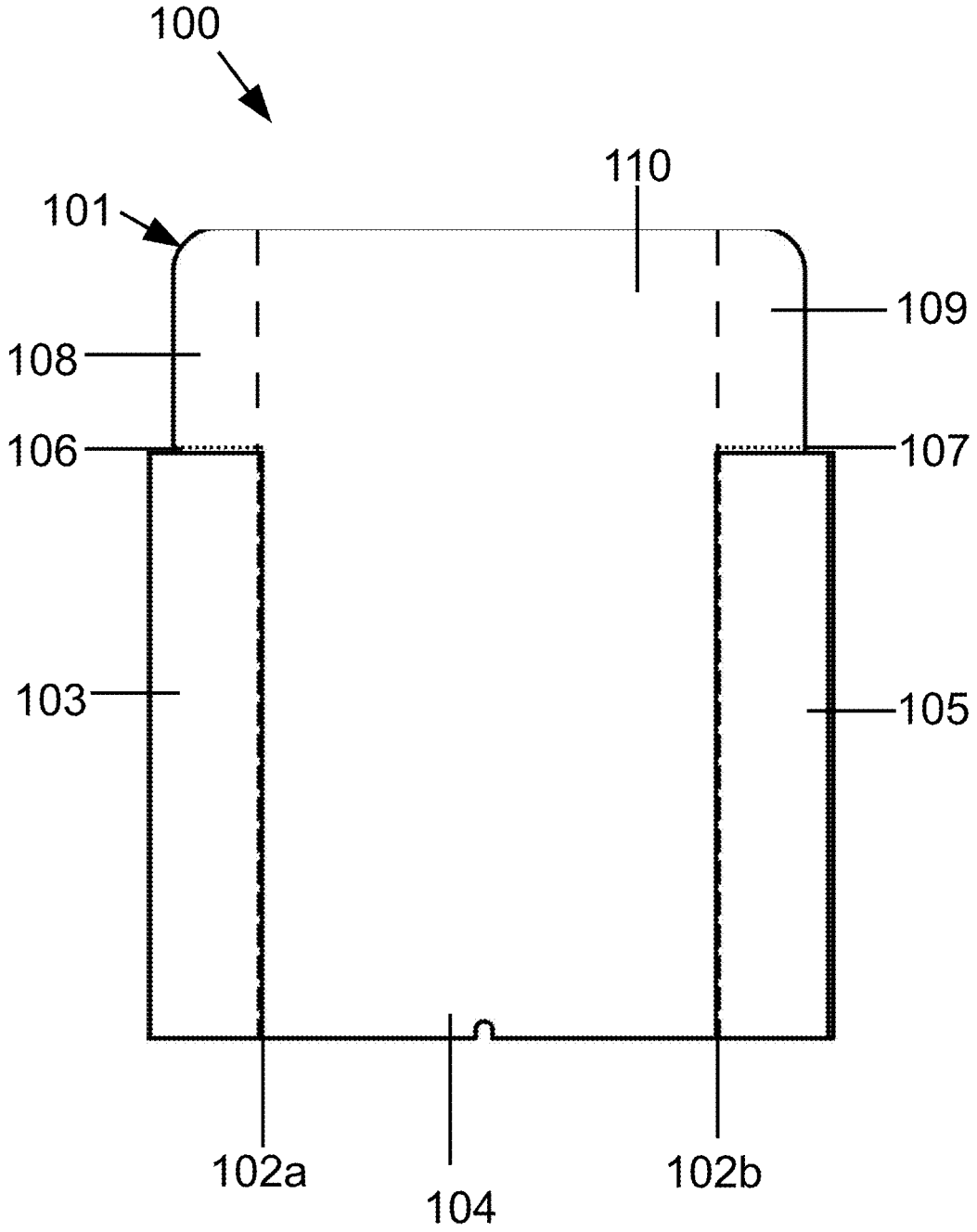
FIG. 1 is a front view of an embodiment of a display board of the present invention.
Figure 11:
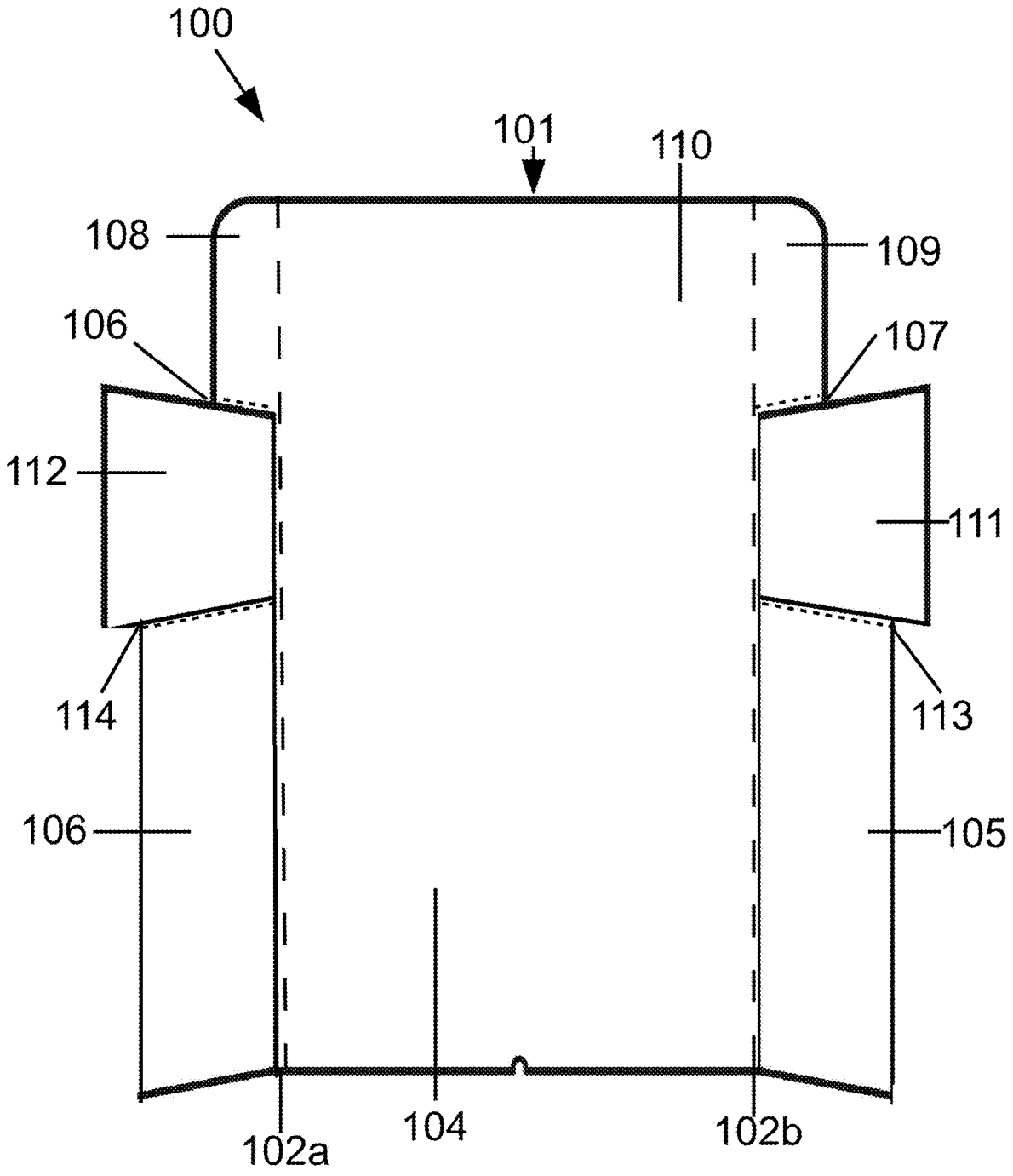
FIG. 11 is a front view of another embodiment of the present invention.
Figure 12:
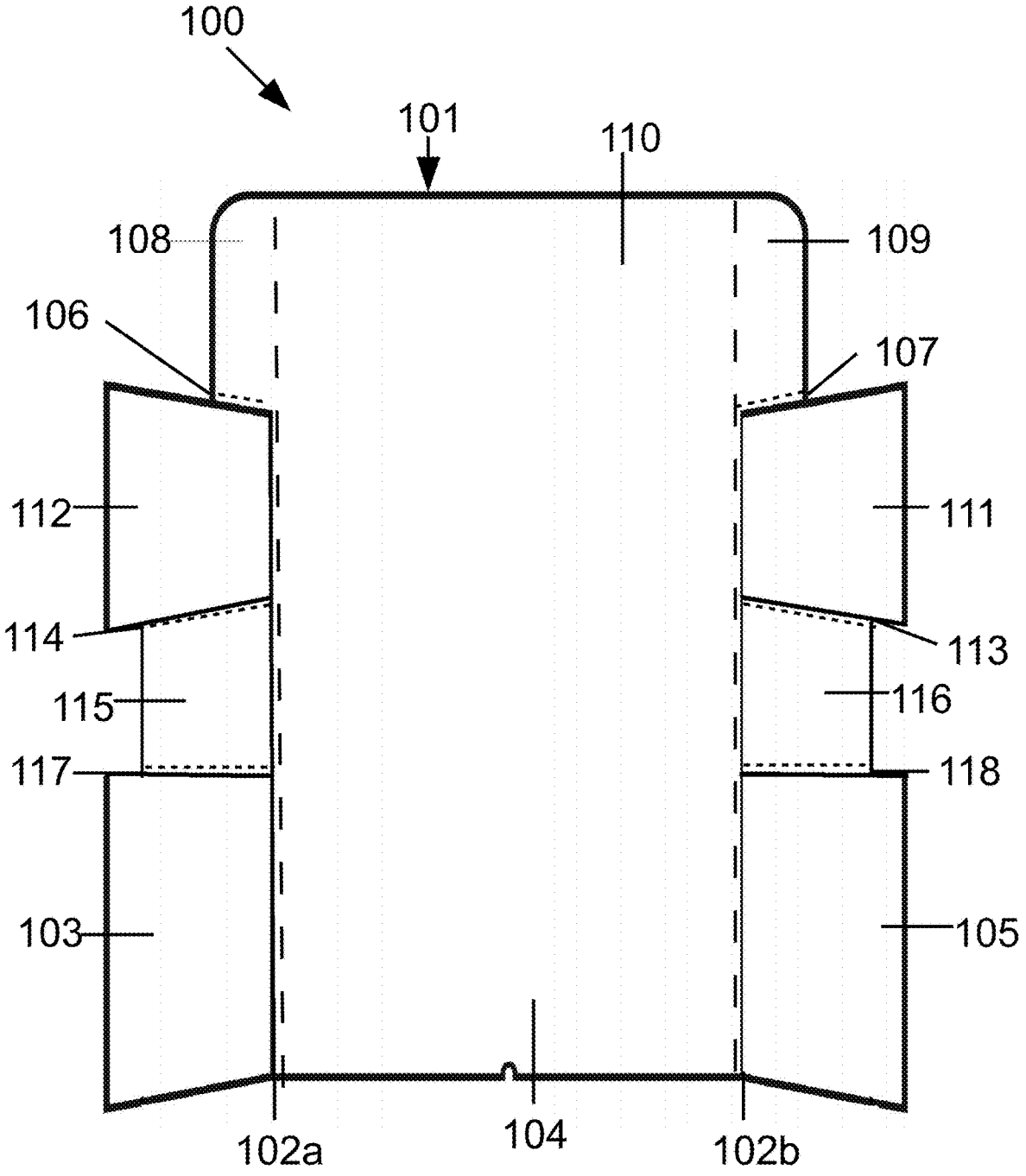
FIG. 12 is a front view of another embodiment of the present invention.

FIG. 1 shows an improved dimensional display board 100 of such type that includes a front face 101, and score marks 102*a* and 102*b* that divide display board 100 into folding panels 103, 104 and 105. Openings 106 and 107 are cut into panels 103 and 105 to make dimensional segments 108 and 109. Segments 108 and 109 in FIG. 1 form dimension 110. Display board 100 is shown in FIG. 1 with two slits in the top portion of the display board 100 but it will be understood that display boards of the present invention may be die cut more than once in more than one location along panels 103 and 105 as seen in FIG. 11 and FIG. 12. It will also be understood that the incisions may be any length along panels 103, 104 and 105 as seen in FIG. 12. It will also be understood that more than one set of cuts of any length can be made along 103, 104 and 105 to form one or more dimensional segments in display board 100 as shown, for example, in FIG. 12.

Figure 2:
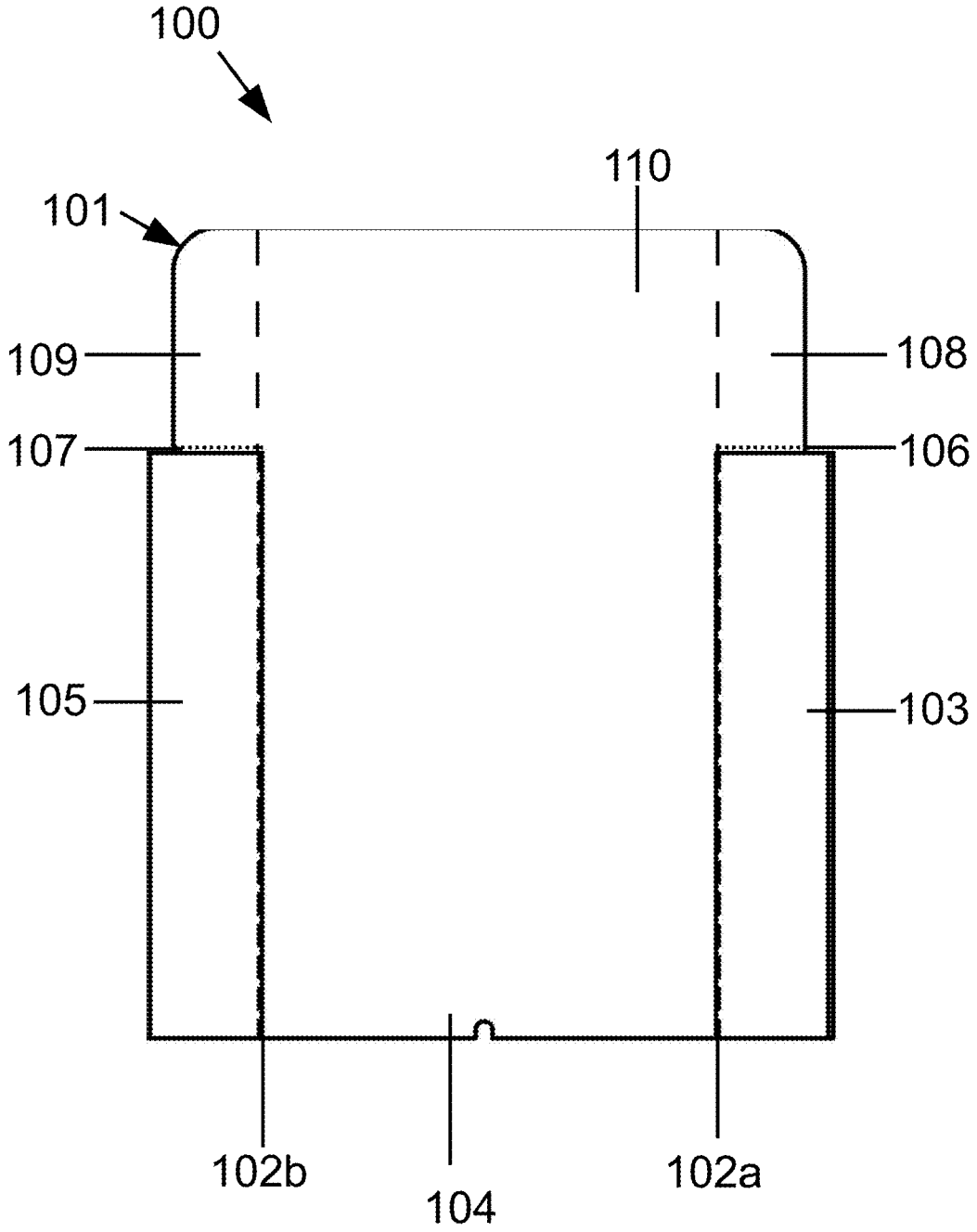
FIG. 2 is a rear view of an embodiment of a display board of the present invention.

In operation, the dimensional display board 100 can be stood on a surface. FIG. 2 shows the back view of improved dimensional display board 100 that includes a rear face 111, and score marks 102*a* and 102*b* that divide display board 100 into folding panels 103, 104 and 105. Openings 106 and 107 divide panels 103 and 105 to make dimensional segments 108 and 109. Segments 108 and 109 form area 110.

Figure 3:
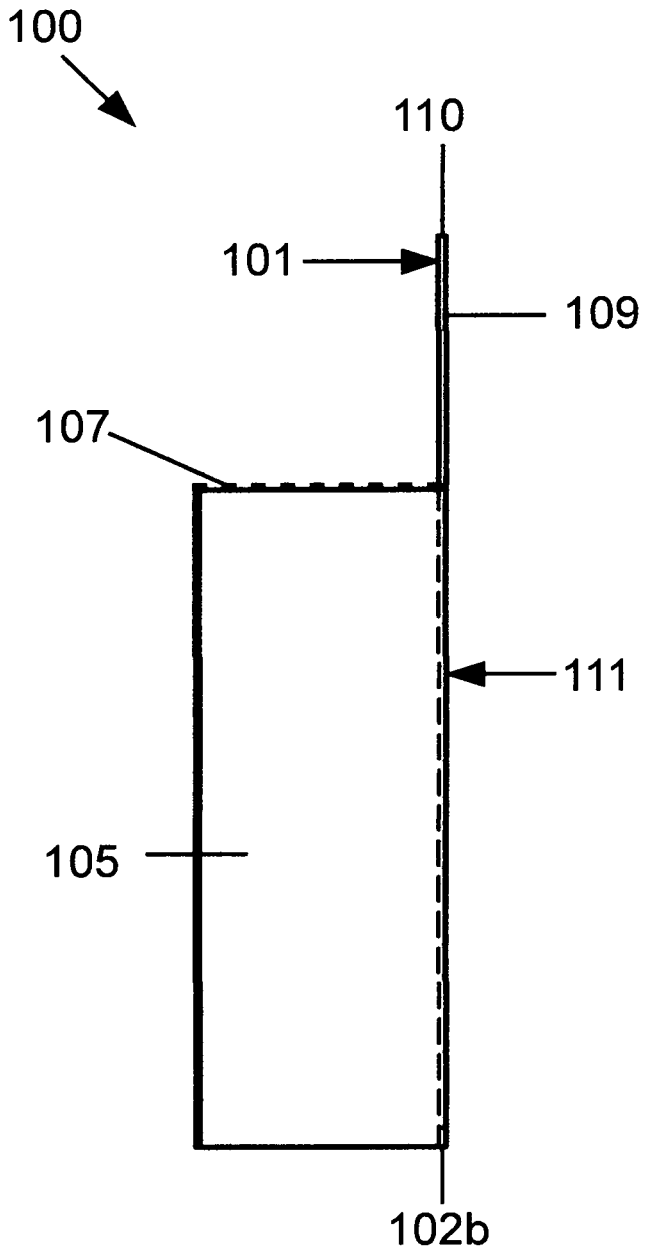
FIG. 3 is a side view of an embodiment of a display board of the present invention.
Figure 4:
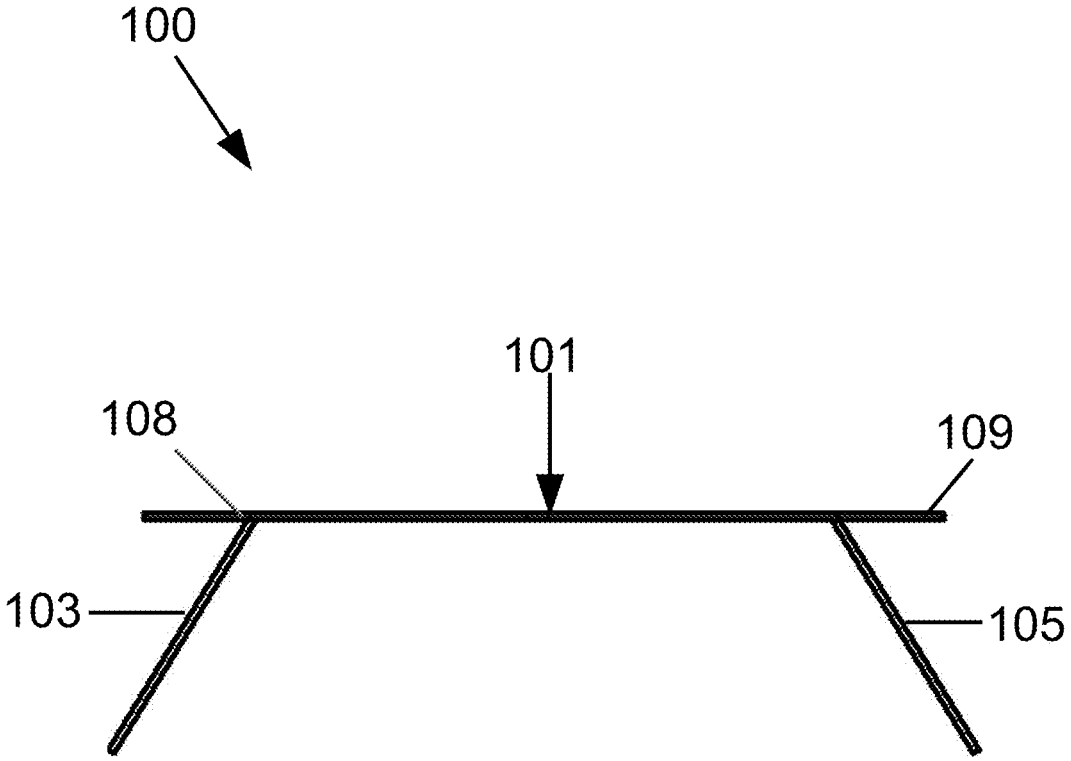
FIG. 4 is a top view of an embodiment of a display board of the present invention
Figure 5:
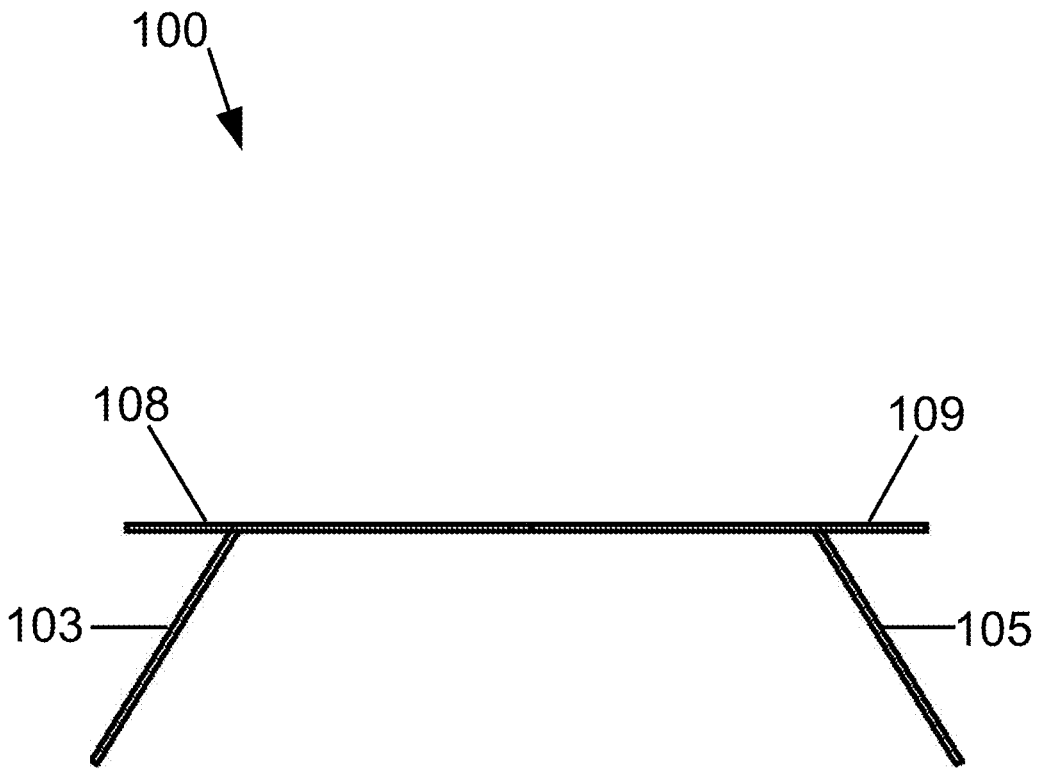
FIG. 5 is a bottom view of an embodiment of a display board of the present invention.
Figure 6:
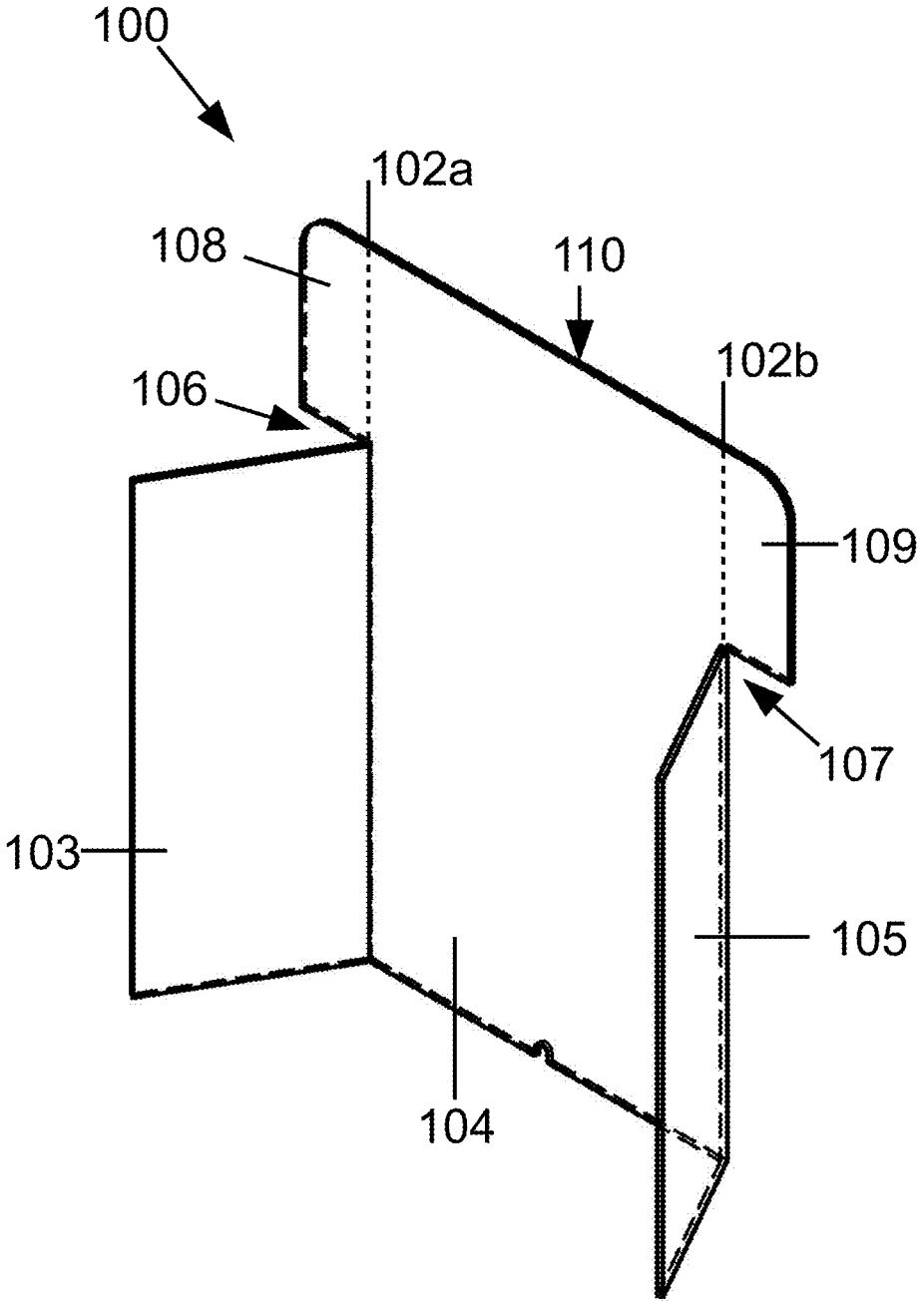
FIG. 6 is an isometric top view of an embodiment of a display board of the present invention.
Figure 7:
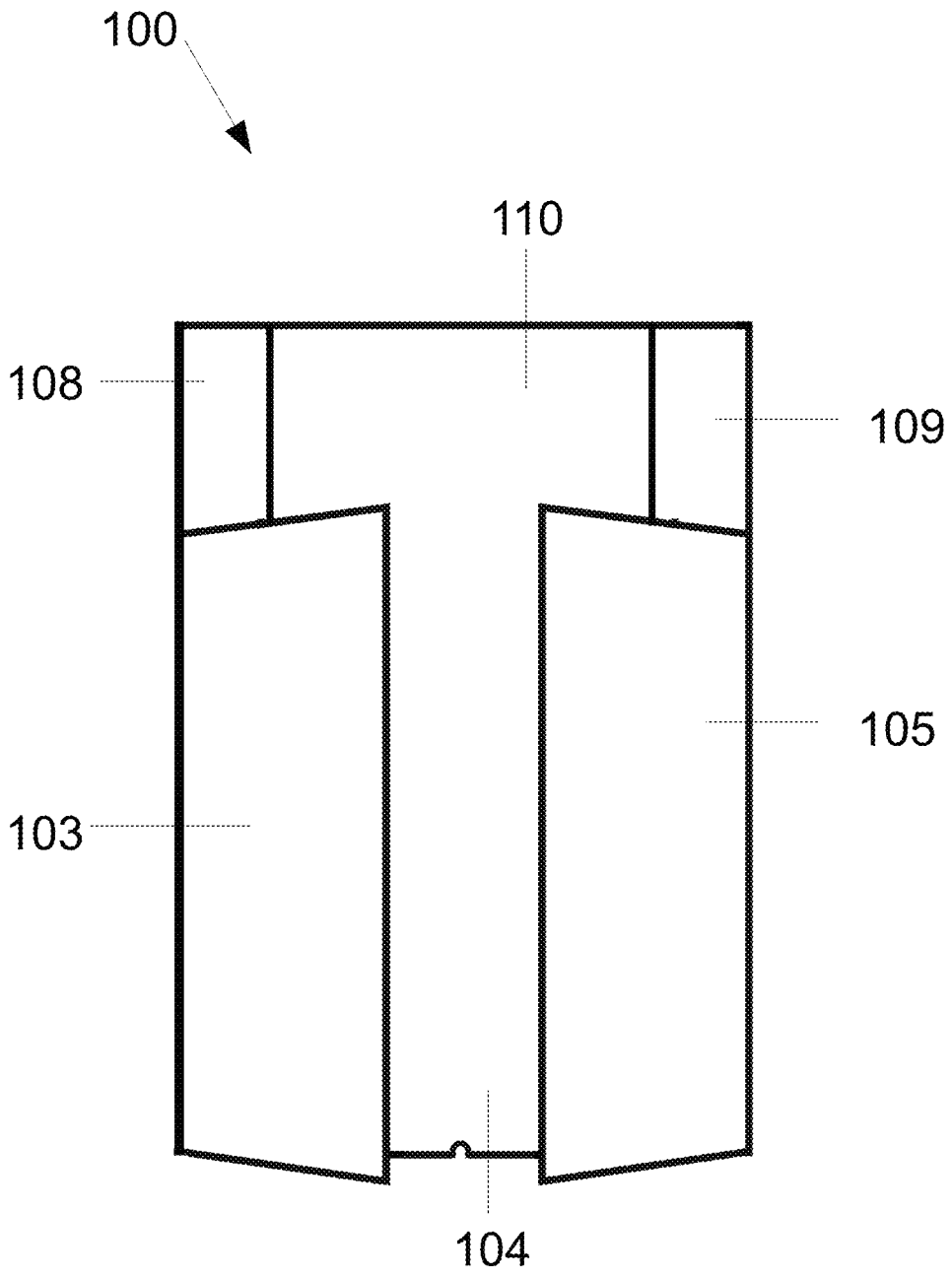
FIG. 7 is a front folded view of a display board of the present invention.

Depth is achieved in display board 100 as shown in FIG. 3 when opening 107 in panel 105 is positioned in opposition to piece 109 and panel 105 is folded forward from rear face 111 along score 102*b*. This configuration as shown from a top perspective in FIG. 4 depicts display board 100 with pieces 108 and 109 at opposing angles on panels 103 and 105. As can be seen in top isometric view FIG. 6, incision 106 divides piece 108 from side 103 and piece 109 is partitioned by slit 107 from side 105. Panels 108 and 109 are positioned to form an upper part 110. FIG. 7 shows improved display board 100 in a folded position for transportation and storage. Sector 103 and member 108 are folded along score 102*a* and sector 105 and member 109*e* folded along score 102*b*.

Figure 8:
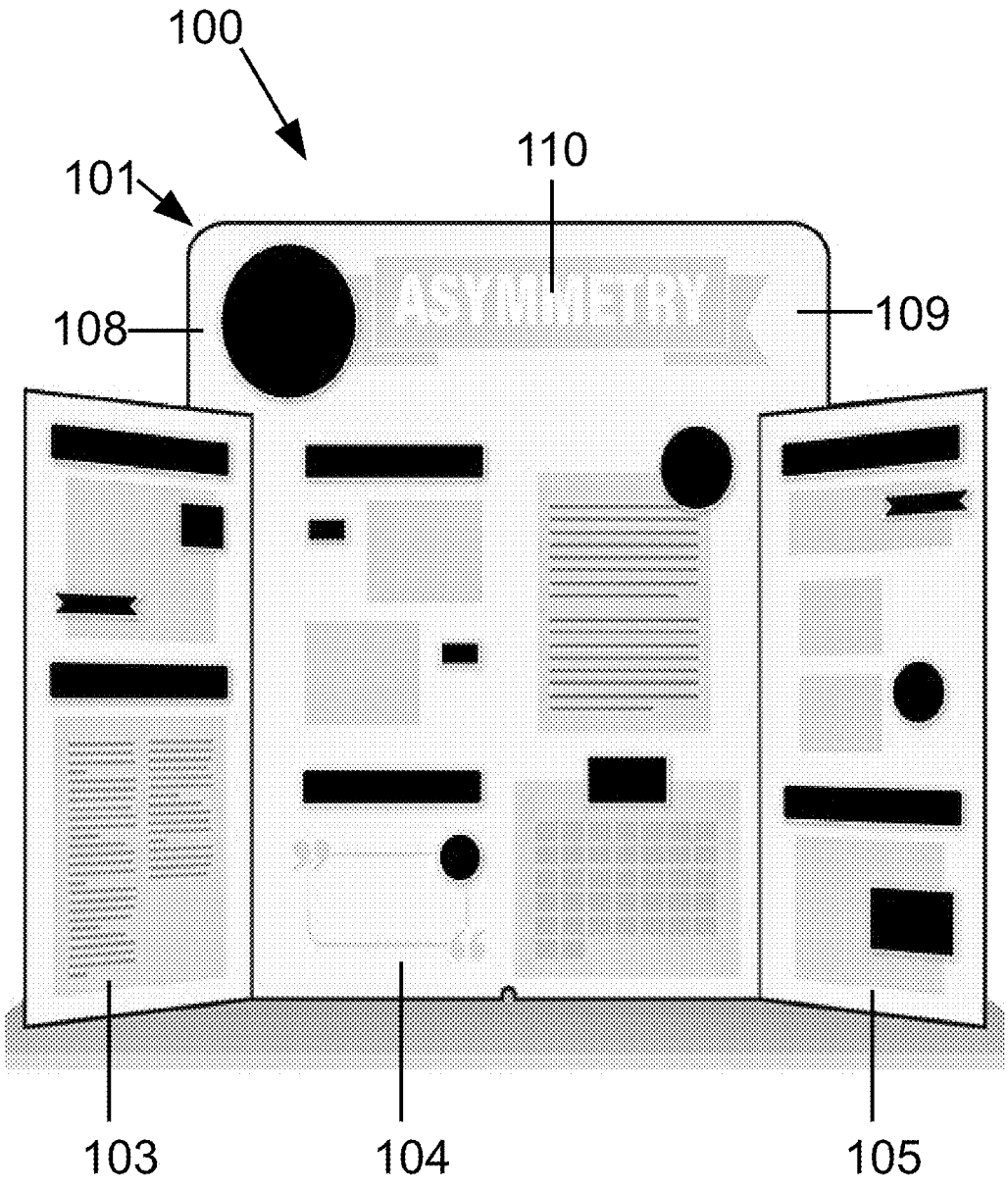
FIG. 8 is a front view of the display board in use.
Figure 9:
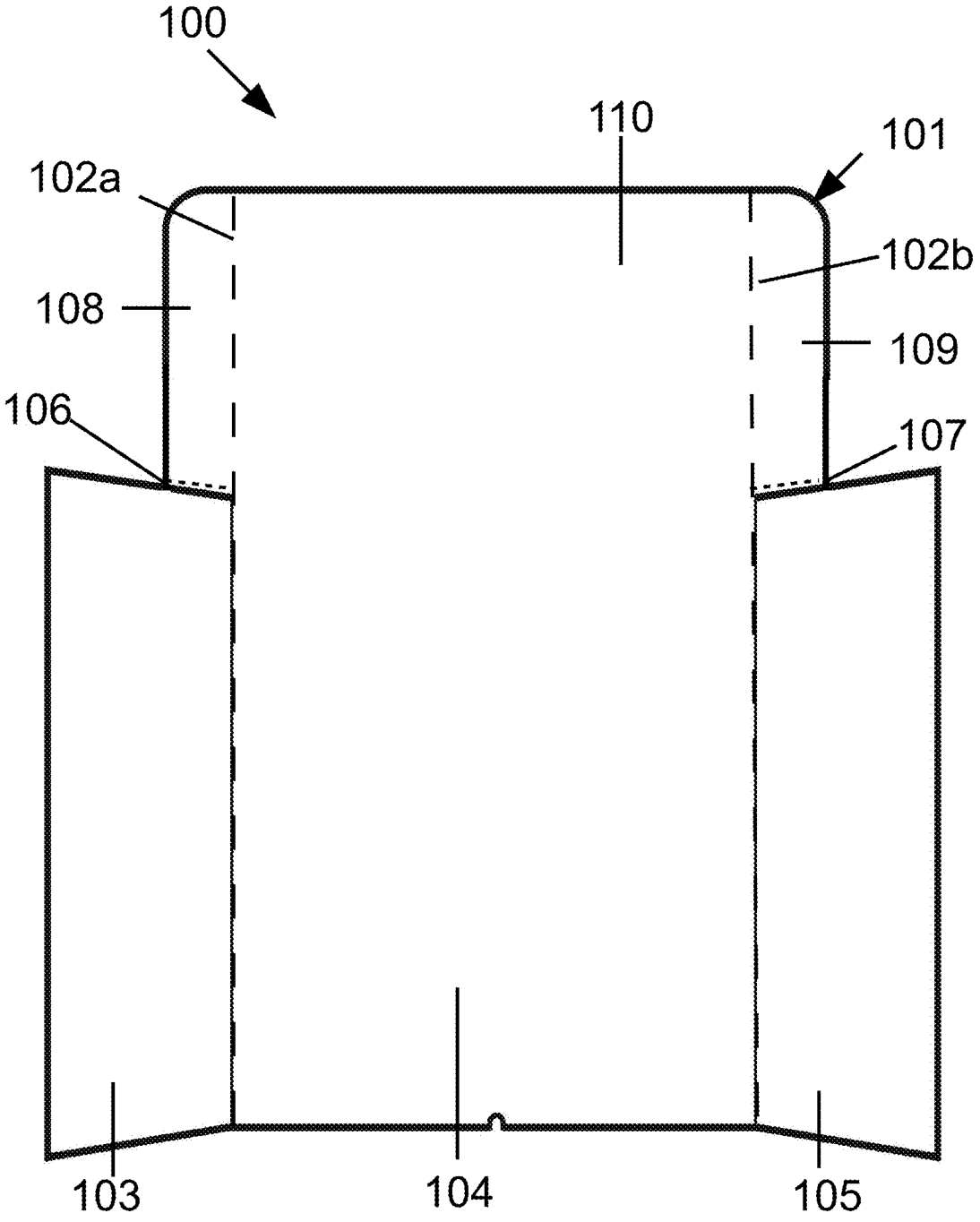
FIG. 9 is a front view of another embodiment of the present invention.
Figure 10:
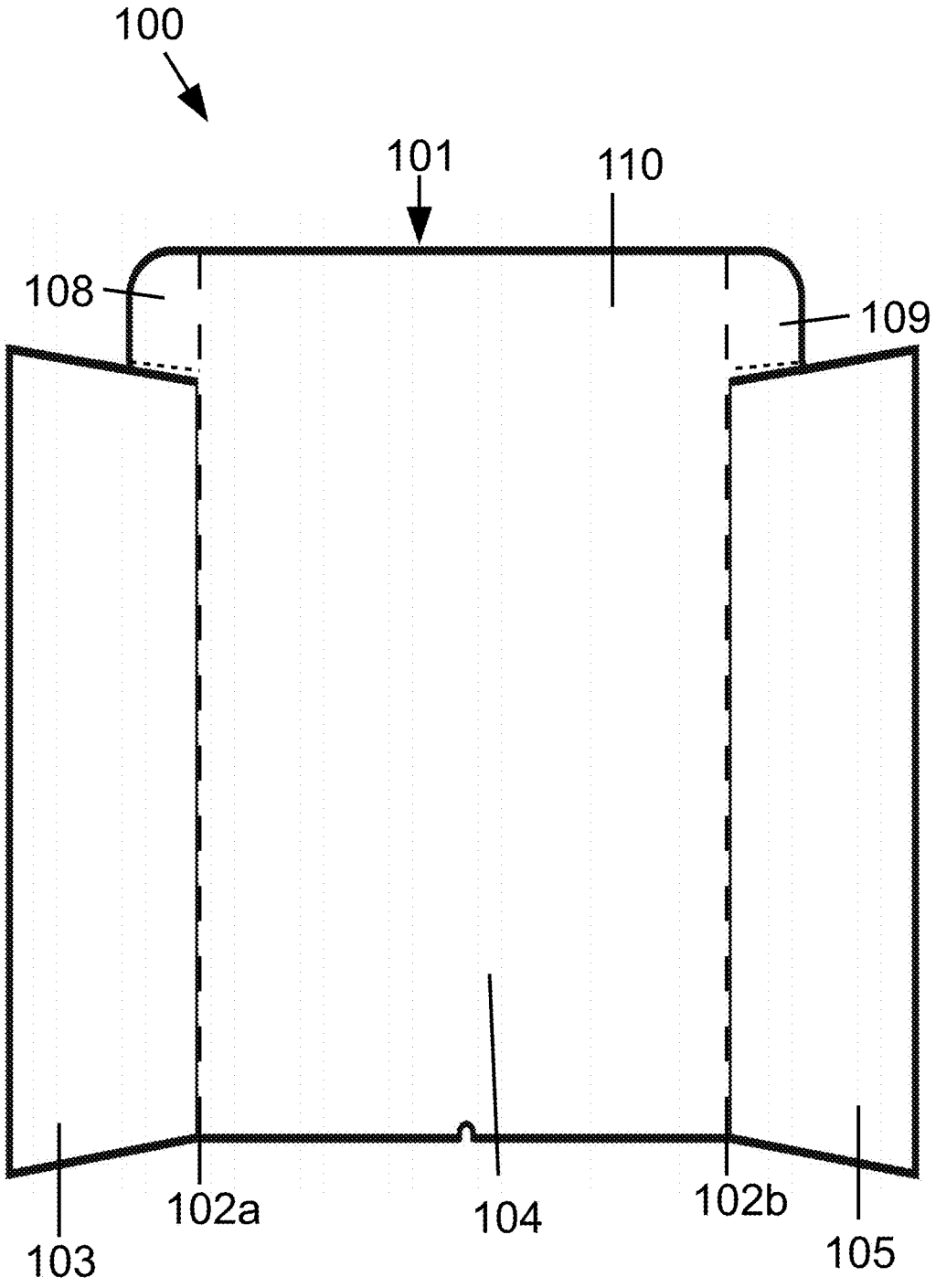
FIG. 10 is a front view of another embodiment of the present invention.

In use, display board 100 may have top 110 for title display as shown in FIG. 8. These types of headers may be of different sizes and positioned in various angles as shown in FIG. 8 and FIG. 9. In both FIG. 8 and FIG. 9, panels 103 and 105 are folded forward along scores 102*a* and 102*b* and sides 108 and 110 are moved back to increase the overall dimensionality of display board 100. Further, this effect may be enhanced by including additional slits as shown in FIG. 11. Additional dimension to the display is acquired when segment 111 is separated from panel 105 by releasing segment 111 along location 113 and segment 112 is formed by dividing panel 106 into panel 112 along release location 114 as shown in FIG. 11. Further breadth, for example, is achieved in display board 100 by adding more openings of different sizes and in differing locations along panels 103 and 105. A multi-dimensional display board 100 is attained by incising panel 103 in to form slits 106, 114 and 117 that form display areas 112, 115 and 103, and slits 107, 113 and 118 may be included in panel 105 to form a display areas 111, 116, and 105 as shown in FIG. 12.

The invention claimed is:

1. A dimensional display system comprising:

a poster board with a front face, a rear face, a first vertical edge along a first side of the board, a second vertical edge along a second side of the board opposite the first side, a top, and a bottom;

a first vertical score mark extending from the bottom to the top along the front face and delineating a first edge segment from the front face;

a second vertical score mark extending from the bottom to the top along the front face and delineating a second edge segment from the front face;

a first horizontal slit extending from the first vertical edge to the first vertical score mark; and a second horizontal slit extending from the second vertical edge to the second vertical score mark, wherein, when the first edge segment is folded along the first vertical score mark toward the front face and the second edge segment is folded along the second vertical score mark toward the front face, a header segment is formed that is in a plane with the front face and extends horizontally beyond the first vertical score mark and the second vertical score mark.

2. The dimensional display system of claim 1 wherein the poster board includes paper pulp.

3. The dimensional display system of claim 1 wherein the poster board includes polymer material.

4. The dimensional display system of claim 1 wherein the poster board includes wood.

5. The dimensional display system of claim 1 wherein the poster board includes fabric.

6. A dimensional display system comprising:

a poster board including:

a front face, a top, a bottom, a first vertical edge along a first side of the poster board, and a second vertical edge along a second side of the poster board opposite the first side;

a first vertical score mark extending from the bottom to the top along the front face; a second vertical score mark extending from the bottom to the top along the front face; a first opening extending from the first vertical edge to the first vertical score mark and forming a first edge segment beneath the first opening; and a second opening extending from the second vertical edge to the second vertical score mark and forming a second edge segment beneath the second opening.

7. The dimensional display system of claim 6, wherein, when the first edge segment is folded along the first vertical score mark toward the front face and the second edge segment is folded along the second vertical score mark toward the front face, a header segment is formed that is in a different plane than the first edge segment and is defined by an area extending from the top to the height of the first opening and from the first side to the second side.

8. The dimensional display system of claim 6, wherein the first opening and the second opening are equidistant from the top.

9. The dimensional display system of claim 8, wherein the first opening and the second opening have equal lengths.

10. The dimensional display system of claim 6, further including a third opening extending from the first vertical edge to the first vertical score mark and a fourth opening extending from the second vertical edge to the second vertical score mark, wherein the first opening and the third opening delineate a first flap, and wherein the second opening and the fourth opening delineate a second flap.

11. The dimensional display system of claim 10, further including a fifth opening extending from the first vertical edge to the first vertical score mark and a sixth opening extending from the second vertical edge to the second vertical score mark, wherein the third opening and the fifth opening delineate a third flap, and wherein the sixth opening and the fourth opening delineate a fourth flap; at least one incision in the poster board, dividing at least a part of a side of a display board into segments; a display board to which at least one perforation is positioned such that the divided segments top portion and the bottom portion are position to somewhat opposing angles.

* * * * *